US009738411B2

(12) United States Patent
Gibson et al.

(10) Patent No.: US 9,738,411 B2
(45) Date of Patent: Aug. 22, 2017

(54) CONTAINER FOR HOLDING AND DISPENSING A CURABLE PRODUCT

(75) Inventors: David J. Gibson, Celbridge (IE); Geoffrey F. Seymour, Kilmacanogue (IE)

(73) Assignee: Henkel IP & Holding GmbH, Duesseldorf (DE)

( * ) Notice: Subject to any disclaimer, the term of this patent is extended or adjusted under 35 U.S.C. 154(b) by 2183 days.

(21) Appl. No.: 11/994,869

(22) PCT Filed: Jul. 5, 2006

(86) PCT No.: PCT/IE2006/000070

§ 371 (c)(1),
(2), (4) Date: Jun. 6, 2008

(87) PCT Pub. No.: WO2007/004203

PCT Pub. Date: Jan. 11, 2007

(65) Prior Publication Data

US 2008/0232896 A1 Sep. 25, 2008

(30) Foreign Application Priority Data

Jul. 5, 2005 (IE) ..... 2005/0450

(51) Int. Cl.
*B65D 1/32* (2006.01)

(52) U.S. Cl.
CPC ..... *B65D 1/32* (2013.01)

(58) Field of Classification Search
CPC ..... B65D 1/32
USPC ... 222/215, 107, 92, 206, 209, 211–213, 95; 401/153, 183
See application file for complete search history.

(56) References Cited

U.S. PATENT DOCUMENTS 2,047,437 A * 7/1936 Sinkler ..... 604/60
2,571,504 A * 10/1951 Vuillemenot ..... 239/327
D198,964 S 8/1964 Dash
3,246,802 A * 4/1966 Fuhrmann ..... 222/95
(Continued)

FOREIGN PATENT DOCUMENTS

CA 1180288 1/1985
DE 2130098 A1 12/1972
(Continued)

OTHER PUBLICATIONS

English translation of JP 2000-107673.*

*Primary Examiner* — Paul R Durand
*Assistant Examiner* — Robert Nichols, II
(74) *Attorney, Agent, or Firm* — Steven C. Bauman

(57) ABSTRACT

A container suitable for dispensing dispensable moisture sensitive curable products such as a CA with a container body which forms an internal reservoir for holding the product a dispensing aperture provided in the container body. Opposing side wall have a curved profile along its path between the front and rear walls which is arranged to regulate a compressibility ratio between the compressive force regulated to move at least one of the front and rear walls toward the other and the distance compressed so that a yield point is not reached, within a compressive dispensing range of movement of said at least one wall, beyond which the container becomes substantially easier to compress. The dispensing force required is predictable and regular while a desired flexibility is achieved.

21 Claims, 5 Drawing Sheets

(56) References Cited

U.S. PATENT DOCUMENTS

| | | | | | |
|---|---|---|---|---|---|
| 3,395,836 | A | * | 8/1968 | Stahmer | 222/215 |
| 3,430,798 | A | | 3/1969 | Goyet | |
| 3,727,803 | A | | 4/1973 | Cobb | |
| 3,926,341 | A | * | 12/1975 | Lhoest | 222/95 |
| 3,982,651 | A | | 9/1976 | Braun et al. | |
| D249,866 | S | | 10/1978 | Felix | |
| 4,413,753 | A | | 11/1983 | Stock | |
| D278,683 | S | | 5/1985 | Biesecker | |
| D284,555 | S | | 7/1986 | Schornagel | |
| D291,283 | S | | 8/1987 | Taylor | |
| D291,284 | S | | 8/1987 | Taylor | |
| 4,748,990 | A | | 6/1988 | Brown et al. | |
| D298,514 | S | | 11/1988 | Dole et al. | |
| D300,265 | S | | 3/1989 | Brown et al. | |
| 4,852,774 | A | | 8/1989 | Crawford | |
| 5,056,689 | A | | 10/1991 | Heyl et al. | |
| 5,098,292 | A | | 3/1992 | Lazarof | |
| 5,135,140 | A | | 8/1992 | Maguire et al. | |
| 5,156,303 | A | * | 10/1992 | Yamamoto et al. | 222/568 |
| 5,197,875 | A | | 3/1993 | Nerli | |
| D335,256 | S | | 5/1993 | Slavin et al. | |
| D338,159 | S | | 8/1993 | Densky et al. | |
| D339,288 | S | * | 9/1993 | Segati | D9/570 |
| 5,357,985 | A | * | 10/1994 | InDelicato et al. | 132/200 |
| D352,780 | S | | 11/1994 | Glaeser et al. | |
| 5,379,927 | A | | 1/1995 | Montenieri et al. | |
| 5,458,854 | A | | 10/1995 | Burns | |
| D374,613 | S | | 10/1996 | Maxwell et al. | |
| 5,649,943 | A | | 7/1997 | Amoils | |
| D385,630 | S | | 10/1997 | Lieb et al. | |
| D392,897 | S | | 3/1998 | Biesecker et al. | |
| 5,819,991 | A | * | 10/1998 | Kohn et al. | 222/215 |
| D409,305 | S | | 5/1999 | Martin et al. | |
| D422,707 | S | | 4/2000 | Bock | |
| 6,170,712 | B1 | * | 1/2001 | Kasboske | 222/215 |
| D453,378 | S | | 2/2002 | Mangione | |
| 6,506,464 | B1 | * | 1/2003 | Montenieri et al. | 428/36.7 |
| D494,678 | S | | 8/2004 | Kemeny et al. | |
| D498,146 | S | | 11/2004 | Densky et al. | |
| D504,948 | S | | 5/2005 | Dragan et al. | |
| D515,214 | S | | 2/2006 | Jackson et al. | |
| D515,215 | S | | 2/2006 | Wang | |
| D532,907 | S | | 11/2006 | Feinbloom et al. | |
| D536,623 | S | | 2/2007 | Ozaki et al. | |
| D558,587 | S | * | 1/2008 | Gibson et al. | D9/571 |
| 7,482,047 | B1 | * | 1/2009 | Tremley et al. | 428/35.7 |
| 2003/0034322 | A1 | | 2/2003 | Doherty et al. | |
| 2004/0214138 | A1 | | 10/2004 | Senn et al. | |

FOREIGN PATENT DOCUMENTS

| | | | |
|---|---|---|---|
| EP | 0055954 | | 7/1982 |
| FR | 2540073 | | 8/1984 |
| JP | 2000-107673 | * | 9/1998 |

* cited by examiner

Position of Ref No.

Position of Ref No.

CONTAINER FOR HOLDING AND DISPENSING A CURABLE PRODUCT

FIELD OF THE INVENTION

The present invention relates to a container suitable for holding and dispensing a curable product and in particular a container suitable for holding and dispensing curable products sensitive to environmental conditions such as moisture. The present invention relates also to a pack comprising the container and with curable product retained within the container.

BRIEF DESCRIPTION OF RELATED ART

For products sensitive to atmospheric conditions, such as moisture sensitive curable products, the container in which they are held for storage (the container is usually at least partially filled with product) and later dispensing must be carefully selected.

Generally it is desirable that dispensing of the contents from the container may be carried out by manual squeezing and in a controlled and predictable fashion.

The material of which the container is formed is one of the important features of the container. In particular due to the sensitive nature of the curable product within the container the material must usually form a sufficient barrier, for example to prevent moisture from passing through the container into the product held inside. Without a sufficient barrier to moisture passing into the product, the product may prematurely cure thus compromising shelf life, and ultimate usability by an end user, such as a consumer. Furthermore the material selected and the container constructed thereof should be suitable for use for controlled dispensing.

The English language abstract for JP2001088815 describes a container constructed so as to deal with the issue of protection of a product which is held internally and which is constructed so as to confer good storage stability for a product retained within the container. The container is made of a polyethylene for a 2-cyanoacrylate composition, having storage stability and squeezability, and improved light resistance by creating a multi-layer extrusion blow moulded container. The container wall has both layers of a low-density polyethylene layer (LD) and a high-density polyethylene layer (HD), and further includes an intermediate density polyethylene layer (MD). A further container directed to improving product stability within the container is described in the English language Abstract for JP11049198. The container body is formed by injection-moulding polyethylene, while a cap member is formed by moulding polypropylene.

In addition to having the required barrier effect it is desirable that the container is flexible to allow dispensing of the product from the container by squeezing (for example manually squeezing by hand). It is desirable that dispensing can be accomplished in a controlled and predictable fashion. It is further desirable that the material of the container is otherwise compatible with the curable product to be held within.

For cyanoacrylate ("CA") containers such as CA bottles moisture barrier in particular is critical for product shelf life. Typically HDPE (high density polyethylene) is used (for cost and compatibility reasons) to achieve a good barrier. Typically a container is moulded from the material. Because of the barrier requirement and due to the fact that certain parts of a plastics material may be stretched more than others during the moulding process (e.g. where the material is stretched around a corner), there has been an appreciation that by creating a container with substantially uniform wall thickness, shelf life of the product can be improved. This in turn is because then there is no one area of the container which forms a lower barrier, in particular to moisture, and which would compromise the shelf life of the product.

However, the uniform thickness requirements which avoid portions of a container which might compromise product life by leading to premature curing, may be achieved at the expense of bottle flexibility. Lack of desired flexibility may in turn reduce ease of use for the end user, for example an end user may then find it more difficult to express product, for example by hand, either because the container is more resilient to squeezing and/or as a result controlled dispensing of the required amount is difficult.

Container shapes which are routinely used for sensitive products such as CA's include round and oval/elliptical shapes as those shapes tend to have least sharp corners (most rounded) as compared for example to flat walled shapes such as rectangular shapes. One such product pack is an oval shaped bottle 20 g bottle containing CA and sold by Henkel®-Loctite® worldwide and which can be obtained from Henkel Ireland Limited, Tallaght, Dublin, Ireland.

SUMMARY OF THE INVENTION

The present invention provides a container suitable for dispensing dispensable moisture sensitive curable products comprising:

a container body which forms an internal reservoir for holding the product;

a dispensing aperture provided in the container body; and optionally a closure for closing the container body, the container body comprising, a base, opposing front and rear walls on the base and opposing (left and right) side walls, each side wall intermediate the front and rear walls and on the base (so that the walls form the reservoir), and the container body being squeezable to allow dispensing of the product through the aperture;

each side wall having a curved profile along its path between the front and rear walls which curved profile is arranged (with the front and rear walls) to regulate a compressibility ratio between the compressive force required to move at least one of the front and rear walls toward the other (thus squeezing the front and rear walls toward each other) and the distance compressed so that a yield point is not reached, within a compressive dispensing range of movement of the walls, beyond which the container becomes substantially easier or substantially more difficult to compress.

The curved profile is thus arranged to effectively act as a compressive force absorber or damper which acts, under compression thereof to increase the compressive force required to squeeze the front and rear walls toward each other so that a yield point is not reached (within a dispensing compressive force range) beyond which the container becomes substantially easier to compress relative to the force applied.

For example the curved profile of the side walls may follow a path which changes direction to turn inwardly (toward the reservoir) and to turn outwardly again.

Generally the sidewalls are resiliently deformable and can also be considered to be arranged to form biasing means for biasing the front and rear walls apart against a compressive force acting to squeeze the front and rear walls together.

Desirably the curved profile runs through substantially all of each side wall. Generally the side wall profiles will be mirror images of each other.

The front and rear walls may be flat or substantially flat. This allows for good handling of the container and dispensing of product.

In this context flat or substantially flat means having no curvature or a low amount of curvature. For example a radius of about 40 mm or greater may be employed for the type of container which may be hand held.

The present invention also relates to a container suitable for dispensing dispensable (moisture sensitive) curable products comprising:

a container body which forms an internal reservoir for holding the product;

a dispensing aperture provided in the container body; and optionally a closure for closing the container body, the container body comprising, a base, opposing front and rear walls on the base and opposing (left and right) side walls, each side wall intermediate the front and rear walls and on the base (so that the walls form the reservoir), and the container body being squeezable to allow dispensing of the product through the aperture;

the container having a compressibility profile where the ratio of the force required to compress the container by moving at least one of the front and rear walls toward the other (thus squeezing them together) to the amount of compression achieved remains relatively constant.

This allows for particularly good dispensing control from the container as compared to prior art containers which reach a yield point beyond which the container becomes substantially easier to compress relative to the force applied.

Having the curved side wall profile as described above is one shape which will have the desired compressibility profile.

Furthermore it is desirable that the containers of the invention demonstrate a suitable flexibility, for example a flexibility which allows (at least initial) compression by a force in the range from 5 to 25 N, more preferably 10 to 20N for example 13 to 18N.

In general, because containers of the invention may be manually squeezed, it is usual that the range of compression which would be considered a normal dispensing range would be relatively modest. Typical distances for normal dispensing would be compression of up to 5 mm, desirably up to 4.5 mm such as up to 4 mm, for example up to 3.5 mm in particular up to 3 mm. It is desirable that containers of the invention show no yield point within these ranges. Indeed prior art containers such as those described above show yield points after compression of about 2 mm, after which the force to distance compressed ratio decreases substantially.

According to one aspect of the present invention desirably the container is constructed so that to cause about 1 mm of compression of the container (by squeezing at least one of the front or rear walls toward the other) a force of from about 6 to about 11N will be required. Another suitable correlation of force to compression is about 2 mm of compression being achievable with from about 11 to about 18N. A further desirable measure is about 3 mm of compression resulting from an applied force of from about 18 to about 25N. Another desirable parameter is that about 4 mm of compression is achieved by a force of from about 25 to about 36N. For example to achieve about 5 mm of compression a force of from about 36 to about 48N may be required. Desirably a container according to the present invention will fit any given combination of said ranges, while it is desirable at least in certain instances that the container will fall within all of said ranges.

A further aspect of the present invention is a pack comprising a container according to the present invention, and moisture sensitive curable product such as CA held within the container.

The containers of the present invention may be constructed of a material selected from the group consisting of polyolefin materials, for example HDPE (high density polyethylene) MDPE (medium density polyethylene), LDPE (low density polyethylene), LLDPE (linear low density polyethylene) and PP (polypropylene) and combinations thereof. For examples blends of polyolefin materials can be used.

The container may be in the form of a bottle. In such a construction the container may have a neck which forms a conduit from the reservoir to the dispensing aperture. The dispensing aperture may take the form of a mouth in the neck. A shoulder portion may connect the neck of the container to the walls thereof.

Desirably, all of the container, and suitably at least that part of the reservoir which is to hold the product, has a wall thickness in the range from 0.4 to 1.5 mm, more preferably 0.6 to 1.2 mm for example 0.75 to 1.1 mm. These thicknesses allow for good barrier properties.

For example the moisture barrier properties should be suitable to hold a cyanoacrylate product for about 18 months or greater when stored from about 2 to about 8° C. without significant loss of performance.

By employing the present invention the present inventors have achieved significantly greater flexibility (squeezability) for a given wall thickness. They have additionally found that for a given increase in container (bottle) weight/body wall thickness (as may be required for better barrier qualities) they find a lower reduction in flexibility. For example when containers of the present invention are compared to the Henkel®-Loctite® 20 g bottle described above, improved flexibility is found. Also the inventors have found that the present invention provides a more desirable compression force profile (damping effect). For example with containers of the present invention, as the distance of compression increases, the force required to continue compression also tends to increase in a substantially linear fashion and thus a more constant ratio between force applied and distance compressed is achieved. This allows for control and predictability of dispensing by squeezing.

In the prior art oval bottles at a certain compression force, an initial yield point is typically reached where after this distance the force increase needed to compress the container is proportionately lower (it gets easier to squeeze, thus resulting in a loss of control). Containers of the present invention have a substantially linear force to compression ratio.

Furthermore the container of the invention facilitates cost effective filling, labelling, general handling and presentation to the customer. Without the present invention it is quite difficult to achieve the flexibility required without compromising the effect.

For example the present inventors have found that even with reducing the container weight by 0.5 g (which may represent a 7% reduction in weight) flexibility may increase by as much as 21%.

While many types of products may be placed within the containers of the present invention the containers of the present invention are particularly suitable for CA's.

BRIEF DESCRIPTION OF THE FIGURES

FIGS. 1A and 1B show the positions at which measurements were taken from the front and rear walls, and side walls of the bottle as set out in Table 1 and Table 2;

DETAILED DESCRIPTION OF THE FIGURES

Figures 1, 1A:
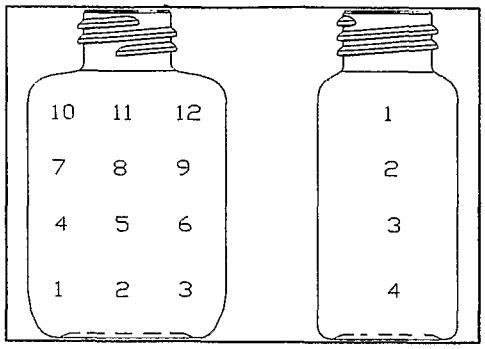
Figures 2A, 2B:
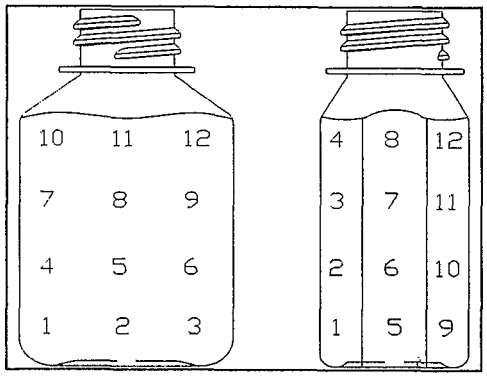
FIGS. 2A and 2B show out the positions at which measurements were taken from the front and rear walls of the bottle as set out in Tables 3-5.

Certain embodiments of containers according to the present invention will now be described with reference to the accompanying Figures, in particular FIGS. 5-12.

Those Figures show a container 1 according to the present invention. The container 1 is suitable for dispensing dispensable curable products in particular moisture sensitive products. The container has a container body 51. The container body 51 forms an internal reservoir 52 for holding the product in question. A dispensing aperture 53 is provided in the container body and in particular is formed by mouth 54 of the container. The mouth 54 is best seen from FIGS. 9-12 where the cap/nozzle closure assembly 55 is removed.

The container 1 further comprises a closure 55 for closing the container body. In the drawings the closure 55 is a cap/nozzle assembly. A cap 57 and the nozzle 56 are as described in co-pending International application number PCT/IE2005/000010 filed on 9 Feb. 2005 to the present applicants. The cap/nozzle assembly as set out in that International application, and as in particular claimed therein are hereby incorporated by reference. Because the cap/nozzle assembly and its function is described in detail in the corresponding co-pending application, its function will not be described in detail again here. In brief, when the cap 57 is removed by relative rotation to the nozzle 56, the nozzle 56 can be employed to dispense the product. When the dispensing of the product is complete, the cap is again refitted either by snap-fitting or relative rotation.

The container body comprises a base 60 and has (opposing) front 61 and rear 62 side walls. The container body comprises opposing side walls namely left side walls 63 and right side walls 64. Each side wall is intermediate to the front and rear walls. All of the walls are on the base 60 and, as can be seen from the drawings, the container body is integrally moulded (formed in one piece). A container 50 as set out in the Figures has been moulded and tested as will be set out in the experimental detail below.

As can be seen from the drawings in particular FIGS. 5, 7, 8, 9, 11 and 12 each side wall is intermediate front and rear walls. Each side wall 63, 64 has a curved profile along its path between the front and rear walls. This curved profile is arranged to increase the compressive force required to squeeze the front 61 and rear 62 walls toward each other. The container 1 is constructed so that a yield point is not reached within a dispensing compressive force range beyond which the container becomes substantially easier (or harder) to compress (the additional distance the walls move toward each other remains substantially constant for equal amounts of additionally applied compressive force).

In the embodiment shown the container 1 is in the form of a bottle. In this construction the container 50 has a neck 70 which forms a conduit from the reservoir 52 to the dispensing aperture 53. The dispensing aperture 53 takes the form of a mouth 54 in the neck 70. A shoulder portion 71 connects the neck 70 of the container to the front, rear and side walls 61-64. Furthermore the neck 70 is provided with a collar 72 which forms a stop for the cap/nozzle assembly 55. Screw threads 73 are provided on the neck 70 so as to allow engagement with reciprocal screw threads on the cap/nozzle assembly 55.

As best seen from FIGS. 5, 7, 8, 9, 11 and 12 the side walls 63 and 64 have a curved profile. In the drawings the front wall 61 and the rear wall 62 are substantially flat. In particular, in the embodiment, the container is of a generally rectangular shape with the side walls significantly shorter than the front and rear walls. The base 60 has a recessed portion 74 bordered by raised rim 75. The rim 75 is formed at the junction of the walls 61-64 and the base 60.

The side walls 63 and 64 are shaped with a curved profile. The curved profile is formed by a sigmoidal or sinuous shape. The sigmoidal profile is exemplified by the junction 82, which is between the walls 61-64 and the shoulder portion 71. In particular the side walls 63 and 64 each have two (convex) lobe portions 80 with an intermediate (concave) dished portion 81. As can be seen from the Figures the lobe portions 80 and the dished portion 81 are elongate and run along substantially all of the side walls. In particular the lobe portions 80 and the dished portion 81 are each arranged with their respective longitudinal axes running parallel to a longitudinal axis of the container 1. It will be apparent that in moving from the lobe portions to the dished portion the side walls follow a path which changes direction to turn inwardly (toward the reservoir or center of the container) and then turn outwardly (away from the reservoir or center of the container) again.

When the container is compressed on one or both of the front and rear walls (as indicated by the arrows "C" in FIGS. 5 and 7) the contents may be expressed. In general the container may be partially or completely filled to the desired extent by any conventional filling process. The container may be moulded such as by blown injection or blown extrusion moulding. In the embodiment the container has been constructed using moulded HDPE. HDPE is particularly suitable for use with CA's.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Experimental Data

Wall Thickness Measurements

The Tables below give wall thickness data in relation to existing bottles used to hold cyanoacrylates. The unit of measurement used in all cases was millimeters. In particular the Table 1 data is a series of wall thickness measurements taken in relation to the 20 g bottle described above. The bottle is constructed of HDPE (and is the US equivalent of the bottle in which Loctite product 401 is sold on the European market under the Product Code No 135428 (product available from Henkel Loctite Ireland Limited)). Herein this bottle will be referred to as the Standard US bottle (abbreviated to "Std. US")

Measurements may be taken using any piece of suitable equipment. One piece of suitable equipment is the "Texture Analyser" equipment provided by Stable Micro Systems mode; XT2i running software Texture Expert Version 1.17.

The standard procedure (which may be carried out using the Texture Analyser) to test a container such as a bottle is to have the container placed (on its side usually) on a flat support such as a test bed, so that the wall of the container to be tested faces upwardly with a 10 mm diameter probe located above the centre of the wall to be tested. The probe, (controlled by the machine) descends vertically (substantially perpendicular to a longitudinal axis of the container) to gradually press on the bottle surface (compressing the bottle) and the force required is measured continuously (measured in Newtons).

Results

TABLE 1

| 20 g Bottle - Standard US | | | | | |
|---|---|---|---|---|---|
| Ref No. | Front | Back | Side 1 | Side 2 | Corners* |
| 1 | 0.957 | 0.812 | 0.755 | 0.628 | 0.580 |
| 2 | 1.034 | 0.965 | 0.996 | 0.946 | 0.590 |
| 3 | 0.927 | 0.972 | 0.992 | 0.979 | 0.700 |
| 4 | 0.836 | 0.778 | 0.800 | 0.811 | 0.712 |
| 5 | 0.930 | 0.843 | | | |
| 6 | 0.853 | 0.836 | | | |
| 7 | 0.850 | 0.795 | | | |
| 8 | 1.000 | 0.941 | | | |
| 9 | 0.800 | 0.810 | | | |
| 10 | 0.745 | 0.726 | | | |
| 11 | 0.812 | 0.820 | | | |
| 12 | 0.752 | 0.761 | | | |
| Weight = 6.0 g | | | | | |
| Average | 0.875 | 0.838 | 0.886 | 0.841 | 0.646 |
| Minimum | 0.745 | 0.726 | 0.755 | 0.628 | 0.580 |
| Maximum | 1.034 | 0.972 | 0.996 | 0.979 | 0.712 |
| Std Dev | 0.0942 | 0.0800 | 0.1263 | 0.1595 | 0.0701 |

Overall Average = 0.835 mm

The reference numerals 1 to 12 represent the positions at which the measurements were taken from the front and rear walls of the bottle and are shown in FIG. 1A. FIG. 1B shows the position at which measurements were taken on the sides of the container.

Table 2 below represents measurements taken in the same way from the 20 g bottle described above. The bottle is constructed of HDPE and is the bottle in which Loctite product 401 is sold on the European market under the Product Code No 135428 (product available from Henkel Loctite Ireland Limited). Herein this bottle will be referred to as the Standard European bottle ("Std. Euro")

TABLE 2

| 20 g Bottle - European | | | | | |
|---|---|---|---|---|---|
| Ref No. | Front | Back | Side 1 | Side 2 | Corners* |
| 1 | 1.204 | 0.991 | 0.571 | 0.639 | 0.550 |
| 2 | 1.414 | 1.264 | 0.709 | 0.679 | 0.535 |
| 3 | 1.242 | 1.260 | 0.903 | 0.801 | 0.820 |
| 4 | 1.324 | 1.190 | 0.936 | 0.830 | 0.920 |
| 5 | 1.384 | 1.290 | | | |
| 6 | 1.149 | 1.208 | | | |
| 7 | 1.020 | 0.938 | | | |
| 8 | 1.024 | 1.052 | | | |
| 9 | 0.823 | 0.933 | | | |
| 10 | 0.914 | 0.890 | | | |
| 11 | 1.040 | 0.949 | | | |
| 12 | 0.861 | 0.773 | | | |
| Weight = 6.5 g | | | | | |
| Average | 1.117 | 1.062 | 0.780 | 0.737 | 0.706 |
| Minimum | 0.823 | 0.773 | 0.571 | 0.639 | 0.535 |
| Maximum | 1.414 | 1.290 | 0.936 | 0.830 | 0.920 |
| Std Dev | 0.2008 | 0.1739 | 0.1715 | 0.0926 | 0.1935 |

Overall Average = 0.973 mm

*Unlike the equivalent bottles of the present invention (such as illustrated below) these containers have some thinning at the corners.

Tables 3 to 5 below give equivalent data to that given above for three variations of bottles according to the present invention. The bottles were manufactured of HDPE as set out above. The bottles of the invention are labelled as "Sigma" bottles and there are three different variations respectively labelled "Prototype 1"; "Prototype 2" and "Prototype 3". The differences between these three containers is in wall thickness and weight as set out in the Tables.

The reference numerals 1 to 12 represent the positions at which the measurements were taken from the front and rear walls of the bottle and are shown in FIG. 1A. FIG. 1B shows the position at which measurements were taken on the side walls of the container.

TABLE 3

| 20 g Sigma Bottle - Prototype 1 | | | | |
|---|---|---|---|---|
| Ref No. | Front | Back | Side 1 | Side 2 |
| 1 | 1.040 | 1.028 | 0.822 | 0.782 |
| 2 | 1.040 | 0.999 | 0.619 | 0.719 |
| 3 | 0.990 | 0.866 | 0.627 | 0.839 |
| 4 | 0.694 | 0.651 | 0.671 | 0.808 |
| 5 | 0.843 | 0.793 | 0.669 | 0.708 |
| 6 | 0.690 | 0.651 | 0.544 | 0.599 |
| 7 | 0.651 | 0.647 | 0.504 | 0.608 |
| 8 | 0.744 | 0.859 | 0.528 | 0.579 |
| 9 | 0.641 | 0.720 | 0.766 | 0.778 |
| 10 | 0.690 | 0.717 | 0.684 | 0.778 |
| 11 | 0.755 | 0.840 | 0.720 | 0.806 |
| 12 | 0.666 | 0.730 | 0.720 | 0.776 |
| Weight = 6.0 g | | | | |
| Average | 0.787 | 0.792 | 0.656 | 0.732 |
| Minimum | 0.641 | 0.647 | 0.504 | 0.579 |
| Maximum | 1.040 | 1.028 | 0.822 | 0.839 |
| Std Dev | 0.1529 | 0.1301 | 0.0969 | 0.0897 |

Overall Average = 0.742 mm

TABLE 4

| 20 g Sigma Bottle - Prototype 2 | | | | |
|---|---|---|---|---|
| Ref No. | Front | Back | Side 1 | Side 2 |
| 1 | 0.882 | 0.926 | 0.723 | 0.809 |
| 2 | 0.845 | 0.846 | 0.866 | 0.870 |

TABLE 4-continued

| 20 g Sigma Bottle - Prototype 2 | | | | |
|---|---|---|---|---|
| Ref No. | Front | Back | Side 1 | Side 2 |
| 3 | 0.798 | 0.873 | 0.954 | 0.953 |
| 4 | 0.661 | 0.685 | 0.809 | 0.889 |
| 5 | 0.900 | 0.954 | 0.693 | 0.733 |
| 6 | 0.673 | 0.694 | 0.696 | 0.698 |
| 7 | 0.690 | 0.704 | 0.752 | 0.736 |
| 8 | 0.984 | 1.098 | 0.726 | 0.711 |
| 9 | 0.697 | 0.715 | 0.778 | 0.818 |
| 10 | 0.712 | 0.759 | 0.883 | 0.890 |
| 11 | 0.799 | 0.879 | 1.006 | 0.930 |
| 12 | 0.709 | 0.730 | 0.844 | 0.813 |
| | | Weight = 6.5 g | | |
| Average | 0.779 | 0.822 | 0.811 | 0.821 |
| Minimum | 0.661 | 0.685 | 0.693 | 0.698 |
| Maximum | 0.984 | 1.098 | 1.006 | 0.953 |
| Std Dev | 0.1051 | 0.1293 | 0.1020 | 0.0871 |

Overall Average = 0.808 mm

TABLE 5

| 20 g Sigma Bottle - Prototype 3 | | | | |
|---|---|---|---|---|
| Ref No. | Front | Back | Side 1 | Side 2 |
| 1 | 1.130 | 1.050 | 0.920 | 0.920 |
| 2 | 1.120 | 1.030 | 0.997 | 0.980 |
| 3 | 1.140 | 0.980 | 1.070 | 1.080 |
| 4 | 0.826 | 0.685 | 0.940 | 1.010 |
| 5 | 1.060 | 0.900 | 0.840 | 0.857 |
| 6 | 0.826 | 0.704 | 0.820 | 0.806 |
| 7 | 0.857 | 0.720 | 0.875 | 0.837 |
| 8 | 1.120 | 1.000 | 0.823 | 0.796 |
| 9 | 0.830 | 0.748 | 1.010 | 1.000 |
| 10 | 0.882 | 0.860 | 1.010 | 0.990 |
| 11 | 1.124 | 1.120 | 1.130 | 1.070 |
| 12 | 0.800 | 0.750 | 1.050 | 1.050 |
| | | Weight = 7.1 g | | |
| Average | 0.976 | 0.879 | 0.957 | 0.950 |
| Minimum | 0.800 | 0.685 | 0.820 | 0.796 |
| Maximum | 1.140 | 1.120 | 1.130 | 1.080 |
| Std Dev | 0.1481 | 0.1547 | 0.1033 | 0.1030 |

Overall Average = 0.940 mm

It is to be noted that the following Table 6 sets out the existing container and the equivalent container according to the present invention. "Equivalence" is considered in terms of wall thickness. The containers are constructed with approximately the same (average) wall thickness and of the same material—in the embodiments the material used is HDPE.

TABLE 6

| Existing Container | Equivalent Container |
|---|---|
| Standard US | Prototype 2 |
| Standard European | Prototype 3 |
| | Prototype 1 |

Flexibility Measurements

Figure 3:
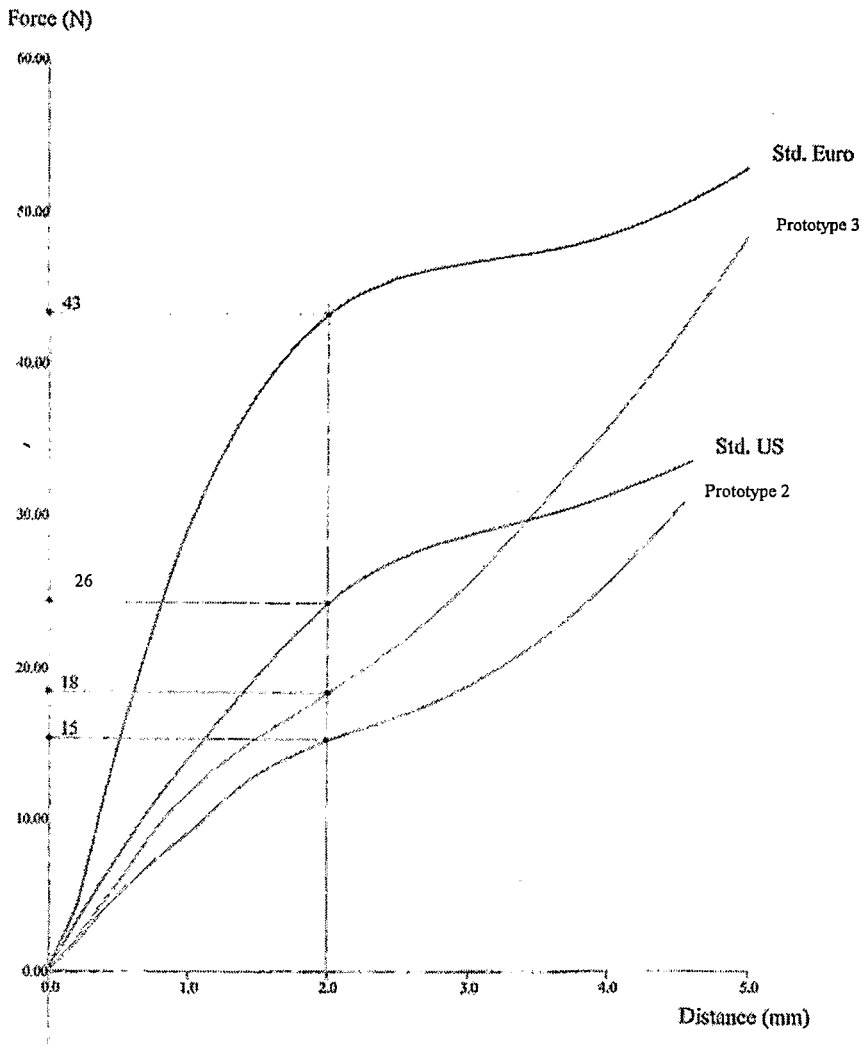
FIG. 3 shows a plot of force required against the distance compressed for various bottle containers including some prior art bottles.
Figure 4:
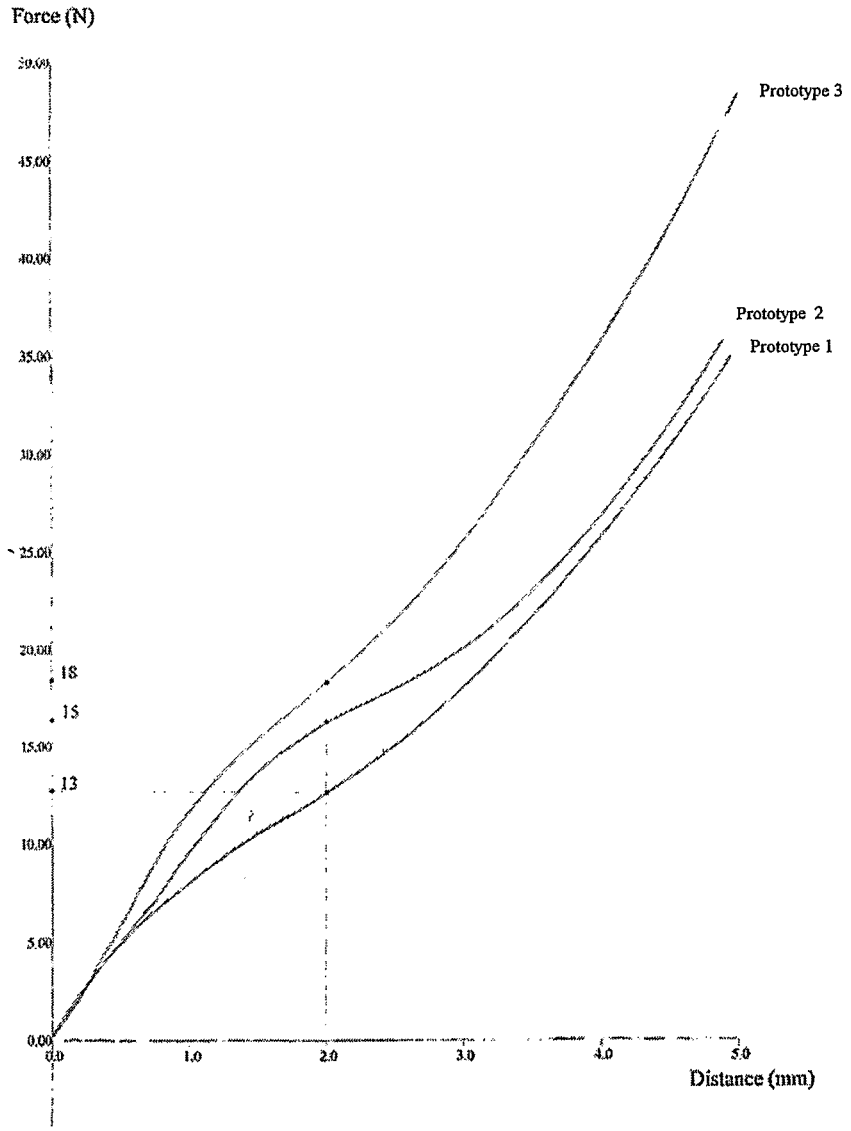
FIG. 4 shows a plot of force required against the distance compressed for various bottle containers within the present invention.
Figure 5:
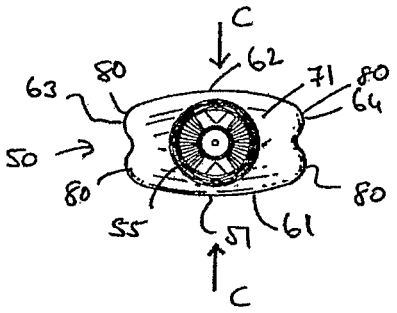
FIG. 5 shows a top plan view of a container of the present invention with a nozzle/cap assembly fitted thereto.
Figure 6:
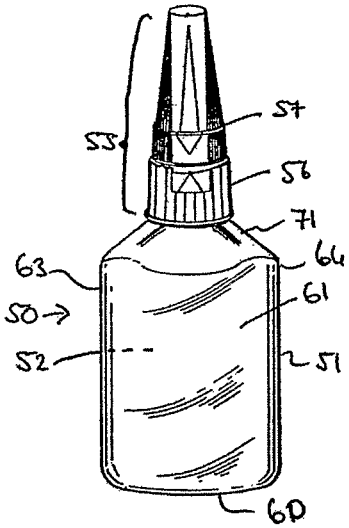
FIG. 6 shows a front elevational view thereof.
Figure 7:
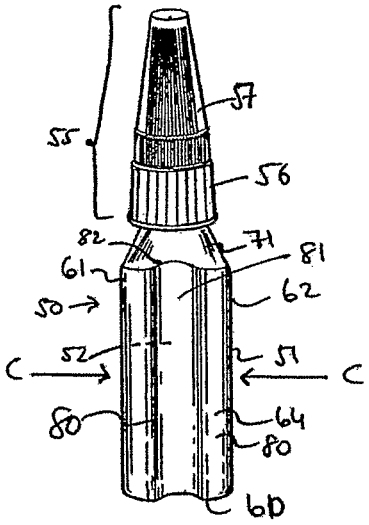
FIG. 7 shows a side elevational view thereof.
Figure 8:
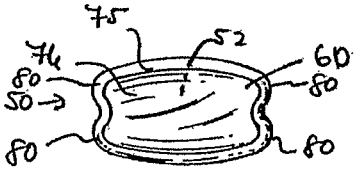
FIG. 8 shows an underneath plan view thereof.
Figure 9:
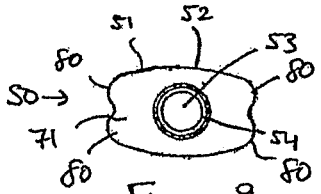
FIG. 9 shows a top plan view of a container of the present invention with no nozzle or cap fitted.
Figure 10:
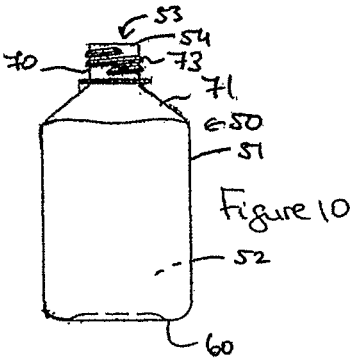
FIG. 10 shows a front elevational view of the container of FIG. 9.
Figure 11:
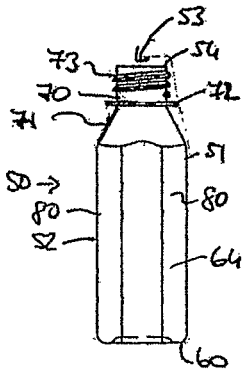
FIG. 11 shows a side elevational view thereof.
Figure 12:
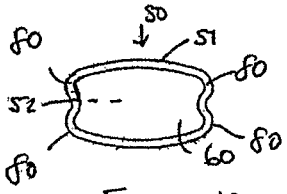
FIG. 12 shows an underneath plan view thereof.

FIGS. 3 and 4 show flexibility measurements for the containers for which wall thickness' measurements were taken. FIG. 3 shows a comparison of containers of the invention with those of the prior art. FIG. 4 shows a compared flexibility of containers according to the present invention.

Conclusion

The wall thickness and flexibility measurements show that the present inventors can achieve a relatively consistent wall thickness with a better distribution which means that the minimum wall thickness is greater as compared to the minimum wall thickness of the existing bottles reviewed, while the overall average wall thickness may be similar. This is achieved while creating a desired flexibility profile. Meanwhile the barrier properties necessary for the stability of retained products are also achieved (see below).

In particular the barrier properties are discussed below.

Looking at the flexibility profiles as set out in the accompanying drawings it is clear that the containers of the present invention show a much more linear relationship of force needed against distance compressed. For example in FIG. 3 it can be clearly seen that the Standard US and standard European bottles each hit a yield point beyond which it becomes substantially easier to compress the bottles—the distance compressed increases much faster than the amount of additional amount of force required to achieve that compression as compared to the situation prior to reaching the yield point. For the Standard US bottle the yield point is reached at about 26 N which equates to a compression of about 2 mm, while for the Standard European bottle a yield point is reached at about 43N which equates to a compression of about 2 mm also.

By contrast the prototypes of the present invention show a substantially constant proportionality in the relationship between the force applied and the distance compressed. This is best seen from FIG. 4 which shows substantially the same compressibility profiles achieved as between the containers of the present invention.

Stability Measurements

Two bottles of the Prototype 2 respectively had 20 g of Loctite product no.s 401 and 406 (both products available from Henkel Loctite (Ireland) Limited, Tallaght Business Park, Tallaght, Dublin, Ireland) placed therein.

Before accelerated ageing conditions were applied the water content of the product (measured in ppm) was taken using the Karl Fischer test.

The bottles were then capped and each subjected to accelerated ageing conditions which were 3 weeks @ 40° C., and at 90% RH (relative humidity). It was then possible to determine the amount of water taken up by the mass of CA by calculating again the amount of water present in the product again utilizing the Karl Fischer method. In this way the amount of moisture which has crossed the barrier of the container can be determined as additional moisture is assumed to have come from outside the container.

Specific Procedure:

Equipment used:

Metrohm 756 KF Coulometer.

This method utilized a methanolic solution of iodine, sulphur dioxide and a base as buffer. Several reactions run in the titration of a water-containing sample and can be summarized by the following overall titration:

$$H_2O+I_2+[RNH]SO_3CH_3+2RN \Leftrightarrow [RNH]SO_4CH_3+2[RNH]I$$

According to the above equation, $I_2$ reacts quantitatively with $H_2O$. This chemical relation forms the basis of the water determination.

Method Description

A known quantity of the test sample is weighed into a 25 ml volumetric flask. 1.0 ml of this solution is then injected into the coulometer. Following a delay of approximately 3 minutes the water content of the sample is displayed.

Results

The results are summarised in Table 7 below:

TABLE 7

| Bottle | Initial (ppm) | 3 weeks (ppm) | Increase (ppm) |
|---|---|---|---|
| Water uptake (product 401) | | | |
| Std European | 654 | 1303 | 649 |
| Std US | 654 | 1710 | 1056 |
| Prototype (2) | 654 | 1630 | 976 |
| Water uptake (product 406) | | | |
| Std European | 518 | 1636 | 1118 |
| Std US | 518 | 2312 | 1794 |
| Prototype (2) | 518 | 1868 | 1350 |

CONCLUSION

As can be seen from the results in Table 8, the Prototype 2 bottle forms a sufficient barrier to provide and adequate shelf life for CA products to be retained therein. It is better in performance to the Standard US bottle to which it is roughly equivalent in terms of average wall thickness, and is comparable in performance to the Standard European bottle which has a greater average wall thickness.

The invention claimed is:

1. A container suitable for dispensing dispensable curable products comprising:

a container body which forms an internal reservoir for holding the product;

a dispensing aperture provided in the container body; and the container body comprising, a base, opposing front and rear walls on the base and resiliently deformable opposing side walls which bias said front and rear walls apart, each side wall intermediate the front and rear walls and on the base, each of the front, rear and side walls having a respective top opposite the base, a neck containing the dispensing aperture, and a tapered shoulder portion connecting the neck with respective tops of the front, rear and side walls, and the container body being squeezable to allow dispensing of the product through the aperture;

each side wall having a sigmoidal or sinuous curved profile along its path between the front and rear walls, the sigmoidal or sinuous curved profile including first and second convex lobe portions adjacent the front and rear walls, respectively, and a concave dished portion intermediate the first and second convex lobe portions, which curved profile is arranged to provide a substantially linear relationship between the compressive force required to move at least one of the front and rear walls toward the other and the distance compressed, within a compressive dispensing range of movement of said at least one of the front and rear walls, so that a yield point is not reached, and at least that part of the reservoir which is to hold the product has a substantially consistent wall thickness.

2. A container according to claim 1 wherein the container has a compressibility profile where the ratio of the force required to compress the container by moving at least one of the front and rear walls toward the other to the amount of compression achieved remains relatively constant.

3. A container according to claim 1, wherein the curved profile of the side walls follows a path which changes direction to turn inwardly and to turn outwardly again.

4. A container according to claim 3 wherein the curved profile runs along substantially all of each side wall.

5. A container according to claim 1 wherein the front and rear walls are flat or substantially flat.

6. A container according to claim 1, wherein the compressive dispensing range of movement of the walls is compression of up to 5 mm.

7. A container according to claim 1 wherein the container is constructed of polyolefin materials.

8. A container according to claim 1 wherein the container is in the form of a bottle.

9. A container according to claim 1 wherein at least that part of the reservoir which is to hold the product, has a wall thickness in the range from 0.4 to 1.5 mm.

10. A container according to claim 1 wherein at least the front and rear walls have a flexibility which allows initial compression by a force in the range from 5 to 25 N.

11. A container according to claim 1 wherein the container is constructed so that a force of from about 6 to about 11 N will move said at least one wall toward the other by a distance of about 1 mm.

12. A container according to claim 1 wherein the container is constructed so that a force of from about 11 to about 18N will move said at least one wall toward the other by a distance of about 2 mm.

13. A container according to claim 1 wherein the container is constructed so that a force of from about 18 to about 25N will move said at least one wall toward the other by a distance of about 3 mm.

14. A container according to claim 1 wherein the container is constructed so that a force of from about 25 to about 36N will move said at least one wall toward the other by a distance of about 4 mm.

15. A container according to claim 1 wherein the container is constructed so that a force of from about 36 to about 48N will move said at least one wall toward the other by a distance of about 5 mm.

16. A container according to claim 1 wherein the curable product is a cyanoacrylate product.

17. A container according to claim 1 constructed of HDPE.

18. A pack comprising:

(i) a container according to claim 1; and (ii) curable product held within the container.

19. A pack according to claim 18 wherein the container is constructed of HDPE and the curable product held within the container is a cyanoacrylate.

20. A container suitable for dispensing dispensable curable products comprising:

a container body which forms an internal reservoir for holding the product;

a dispensing aperture provided in the container body; and the container body comprising, a base, opposing front and rear walls on the base and resiliently deformable opposing side walls which bias the front and rear walls apart, each side wall intermediate the front and rear walls and on the base, each of the front, rear and side walls having a respective top opposite the base, a neck containing the dispensing aperture, and a tapered shoulder portion connecting the neck with respective tops of the front, rear and side walls, and the container body being squeezable to allow dispensing of the product through the aperture;

the container having a compressibility profile of curvature or thickness, evidenced in that the ratio of the force required to compress the container by moving at least one of the front and rear walls toward the other to the amount of compression achieved remains relatively constant, and at least that part of the reservoir which is to hold the product has a substantially consistent wall thickness.

21. A container according to claim 20 wherein each side wall has a curved profile along its path between the front and rear walls, the curved profile including first and second convex lobe portions adjacent the front and rear walls, respectively, and a concave dished portion intermediate the first and second convex lobe portions, and which curved profile is arranged to regulate a compressibility ratio between the compressive force required to move at least one of the front and rear walls toward the other and the distance compressed so that a yield point is not reached, within a compressive dispensing range of movement of the said at least one wall, beyond which the container becomes substantially easier or substantially more difficult to compress.

* * * * *